US008833354B2

(12) United States Patent
Tresserras Torre et al.

(10) Patent No.: US 8,833,354 B2
(45) Date of Patent: Sep. 16, 2014

(54) BUSHING FOR THE CHAMBER OF A SPORTING PISTOL OR RIFLE AND MANUFACTURING METHOD

(75) Inventors: Victor Tresserras Torre, Sant Boi de Llobregat (ES); Julian Arnedo Vera, Sant Boi de Llobregat (ES)

(73) Assignee: Gamo Outdoor, SL, Sant Boi de Llobregat (ES)

( * ) Notice: Subject to any disclaimer, the term of this patent is extended or adjusted under 35 U.S.C. 154(b) by 0 days.

(21) Appl. No.: 14/123,434

(22) PCT Filed: May 30, 2011

(86) PCT No.: PCT/ES2011/070390

§ 371 (c)(1), (2), (4) Date: Dec. 3, 2013

(87) PCT Pub. No.: WO2012/164106

PCT Pub. Date: Dec. 6, 2012

(65) Prior Publication Data

US 2014/0096760 A1 Apr. 10, 2014

(51) Int. Cl.

| | |
|---|---|
| ***F41B 11/70*** | (2013.01) |
| ***F41B 11/72*** | (2013.01) |
| ***F41B 11/723*** | (2013.01) |
| ***B21D 19/08*** | (2006.01) |

(52) U.S. Cl.

CPC ..... *F41B 11/70* (2013.01); *F41B 11/72* (2013.01); *F41B 11/723* (2013.01); *B21D 19/08* (2013.01)

USPC ..... 124/73; 124/83; 42/133; 42/1.06; 42/73

(58) Field of Classification Search

USPC ..... 124/73, 83; 42/133, 1.06, 73–74

See application file for complete search history.

(56) References Cited

U.S. PATENT DOCUMENTS

| | | | | | |
|---|---|---|---|---|---|
| 807,712 | A | * | 12/1905 | Bassell | 42/133 |
| 2,061,017 | A | * | 11/1936 | Arden | 42/133 |
| 2,457,648 | A | * | 12/1948 | Donner | 285/323 |
| 3,265,412 | A | * | 8/1966 | Reid et al. | 285/323 |
| 3,456,351 | A | * | 7/1969 | Gehmann | 42/133 |
| 4,366,625 | A | * | 1/1983 | Gehmann | 42/117 |
| 4,833,786 | A | * | 5/1989 | Shores, Sr. | 33/265 |
| 4,865,363 | A | * | 9/1989 | Takahashi | 285/323 |
| 4,893,606 | A | * | 1/1990 | Sisko | 124/89 |
| 5,600,094 | A | * | 2/1997 | McCabe | 174/653 |
| 6,360,473 | B1 | | 3/2002 | Merchant | |
| 7,797,874 | B2 | * | 9/2010 | Neergaard | 42/111 |

FOREIGN PATENT DOCUMENTS

| | | | |
|---|---|---|---|
| WO | 9830859 | A1 | 7/1998 |
| WO | 2005063344 | A1 | 7/2005 |

* cited by examiner

*Primary Examiner* — Michael David
(74) *Attorney, Agent, or Firm* — RatnerPrestia

(57) ABSTRACT

Bushing for the chamber of a sporting pistol or rifle and the procedure for its manufacture. It comprises a tubular configuration, with a connection passage with its entrance orifice (2) and exit orifice (4) characterized in that said connection passage (8) is calibrated to a predetermined value in function of the output power of the sporting pistol or rifle.

8 Claims, 5 Drawing Sheets

BUSHING FOR THE CHAMBER OF A SPORTING PISTOL OR RIFLE AND MANUFACTURING METHOD

CROSS REFERENCE TO RELATED APPLICATIONS

This patent application claims priority to international patent application number PCT/ES2011/070390, filed May 30, 2011, and entitled "Sleeve for the Chamber of a Sport Pistol of Sport Rifle and Method for Manufacturing Same." The subject matter of patent application number PCT/ES2011/070390 is hereby incorporated by reference in its entirety.

FIELD OF THE INVENTION

Bushing for the chamber of a sporting pistol or rifle and manufacturing method, of the type that comprises a tubular configuration, with a connection passage with its entrance orifice and exit orifice characterised in that said connection passage is calibrated to a predetermined value in function of the output power of the sporting pistol or rifle.

BACKGROUND OF THE INVENTION

Various sporting rifles or pistols are known in the state of the art that adapt to various output powers depending on the country. For this, they employ springs in the sporting rifle or pistol chamber.

The applicant company of Spanish Utility Model No 0210145 "PNEUMATIC RIFLE WITHOUT RECOIL EFFECT", of 1975, currently in the public domain, which refers to a pneumatic rifle without recoil effect, essentially characterised in that the assembly comprising the pneumatic chamber, barrel, air compressor piston and drive spring, together with the associated housing and securing components form a mobile group that is forward when the rifle is loaded by breaking the barrel, remain retained during the time in which the rifle is loaded and which is released, permitting its movement, after the same is fired, compensating said recoil movement that of the conventional rifle recoil, due to the reaction produced by the shock of the piston against the front part of the chamber. FIGS. 1 and 2 of reference 17 show the output power regulator spring or drive spring.

SUMMARY OF THE INVENTION

This invention is an improvement in the compressed air or gas sporting pistol or rifle manufacturing sector.

As can be appreciated from the invention background, one of the major drawbacks facing today's manufacturers is the fact that very costly methods are employed to regulate the output power of rifles or pistols, which involve a large amount of various parts stock, for example, springs.

The case of using springs to regulate the rifle power output requires a large number of springs with various elastic constants in order to cover all requirements.

This means that a rifle manufacturer, for example, must have a large stock or springs to meet the requirements of widely varying countries, such as Germany, Spain or the USA.

This invention intends to avoid the previously mentioned drawbacks and to enable the sporting rifle or pistol to adapt to any country and also to possible legislative modifications.

Thus, this application avoids the stocks of springs with various elastic constants, because it is the bushing that regulates the sporting rifle or pistol output power and so the same firing mechanism can always be employed without any variation.

At the same time, with this invention, mechanically rifles with less power have to withstand less mechanical stress (proportional to the rifle power), the spring impact is reduced in rifles having less power and in other words, their durability is increased.

Lastly, with respect to noise, this is reduced in a significant manner because the spring impact is less in low-power rifles.

One objective of this invention is a bushing for a sporting pistol or rifle chamber, of the type that comprises a tubular configuration, with a connection passage with its entrance orifice and exit orifice characterised in that said connection passage is calibrated to a predetermined value in function of the output power of the sporting pistol or rifle.

An additional goal of this invention is a method for the manufacture of a bushing for a sporting pistol or rifle chamber of the type that comprises a tubular configuration, with a connection passage with its entrance orifice and exit orifice characterised in that said connection passage is calibrated to a predetermined value in function of the output power of the sporting pistol or rifle.

BRIEF DESCRIPTION OF THE DRAWINGS

In order to facilitate the description, this report is accompanied by five sheets of drawings that represent a practical embodiment case, which is provided for guidelines purposes that does not limit the scope of this invention.

DETAILED DESCRIPTION

Figure 1:
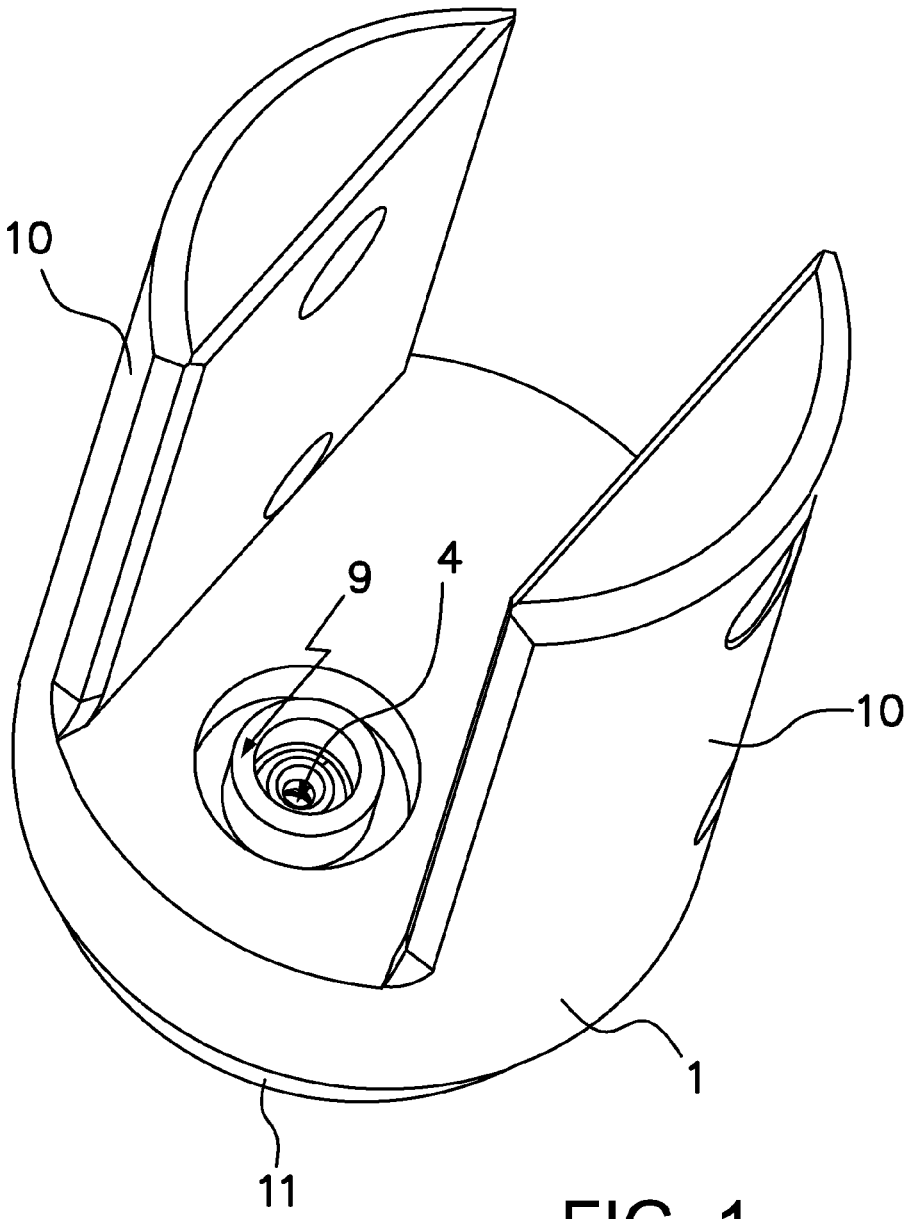
FIG. 1 is a perspective view of the bushing covered by this invention.

FIG. 1 represents a finished bushing 1 in the form of a fork with its extensions 10, an exit orifice 4 and cavity 9.

Figure 2:
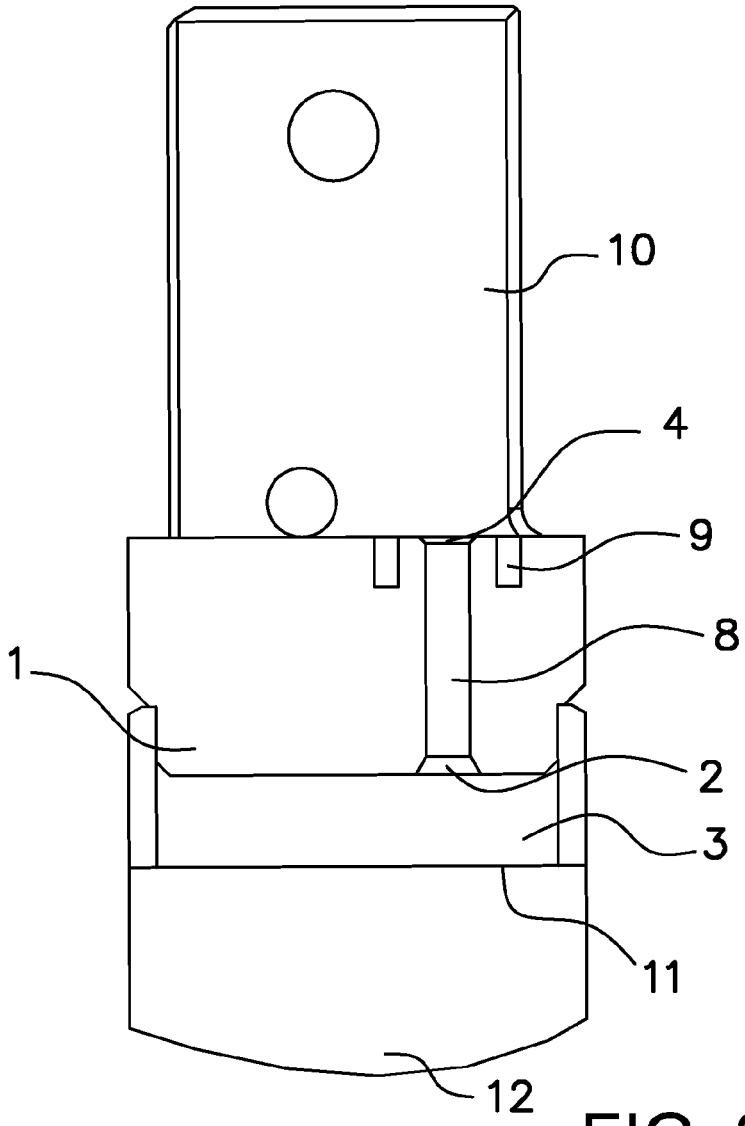
FIG. 2 is a section view of the bushing before the beginning of the method.

FIG. 2 illustrates bushing 1 with its extensions 10, rifle chamber 12, entrance orifice 2, a connection passage 8, exit orifice 4, cavity 9 and compression chamber 3.

Figure 3:
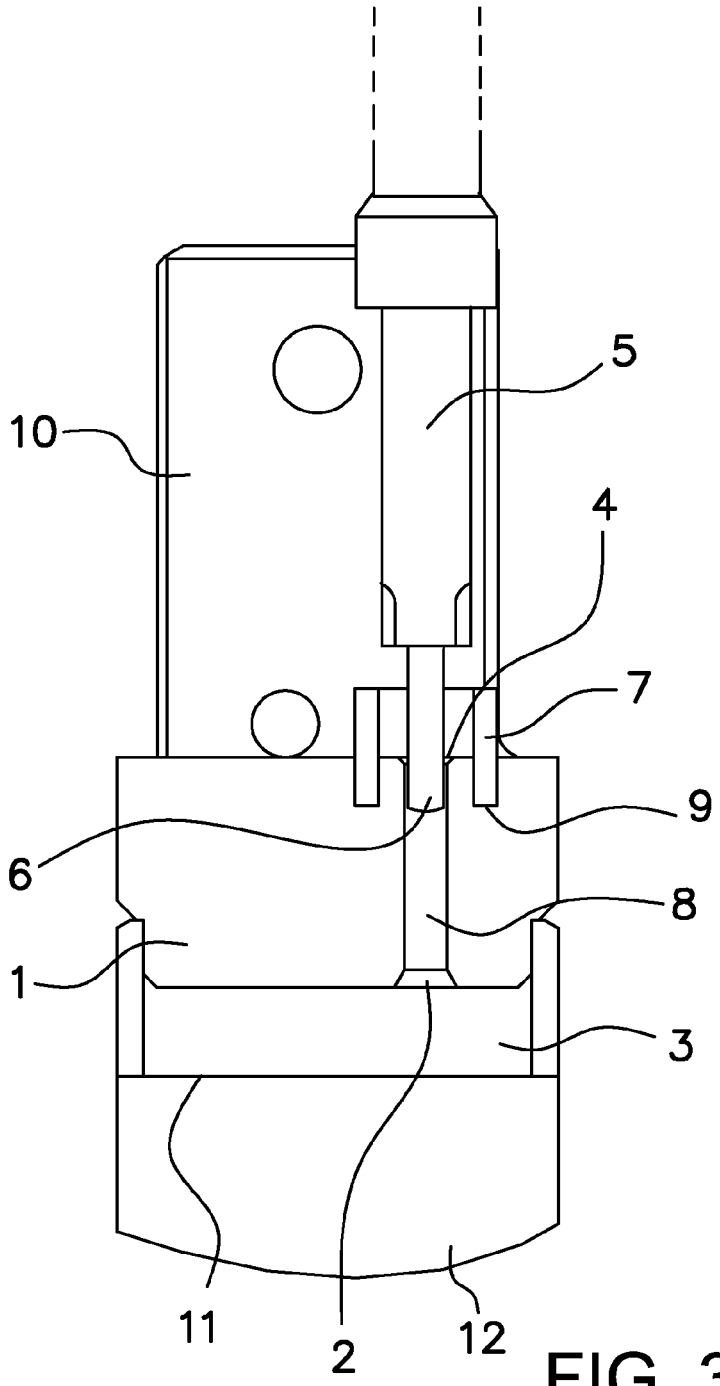
FIG. 3 is a section view of the bushing before the tool striking the bushing.

FIG. 3 shows bushing 1 with its extensions 10, rifle chamber 12, entrance orifice 2, connection passage 8, exit orifice 4, cavity 9, compression chamber 3, forming tool 5, calibrating plunger 6 and centering element 7.

Figure 4:
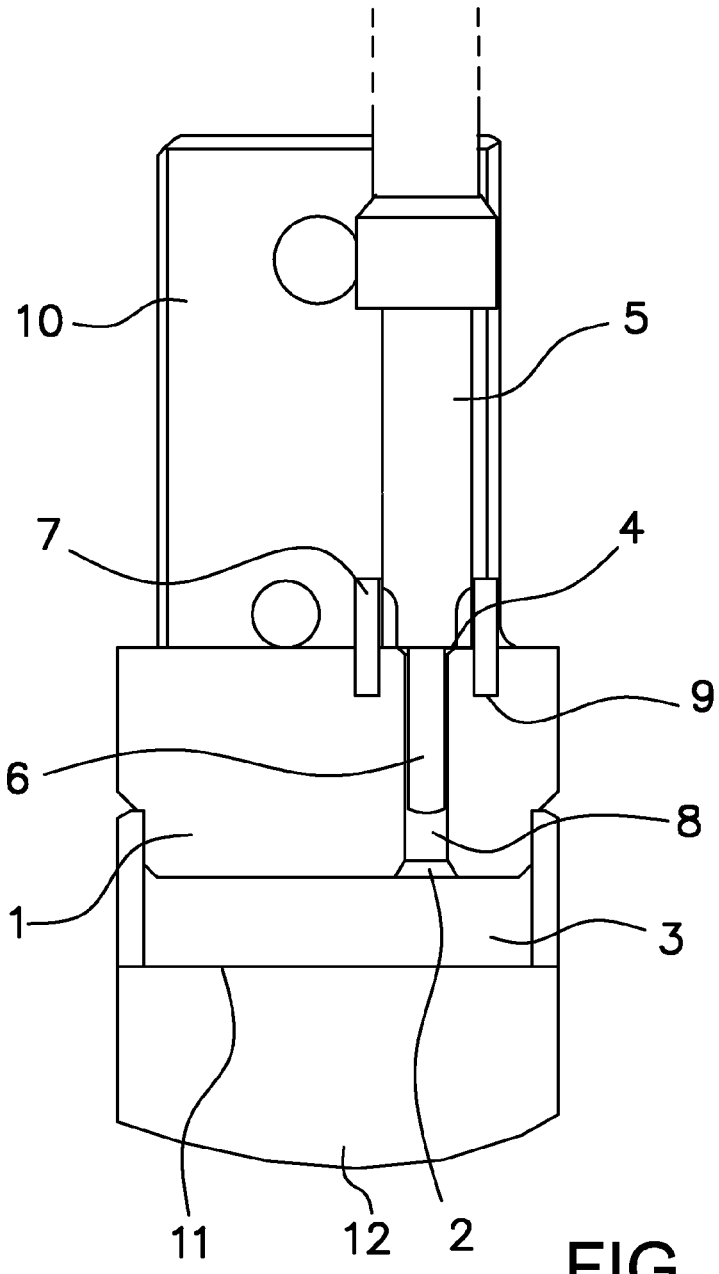
FIG. 4 is a section view of the bushing when it is struck by the tool.

FIG. 4 shows bushing 1 with its extensions 10, rifle chamber 12, entrance orifice 2, connection passage 8, exit orifice 4, cavity 9, compression chamber 3, forming tool 5, calibrating plunger 6 and centering element 7, at the beginning of the formation stage.

Figure 5:
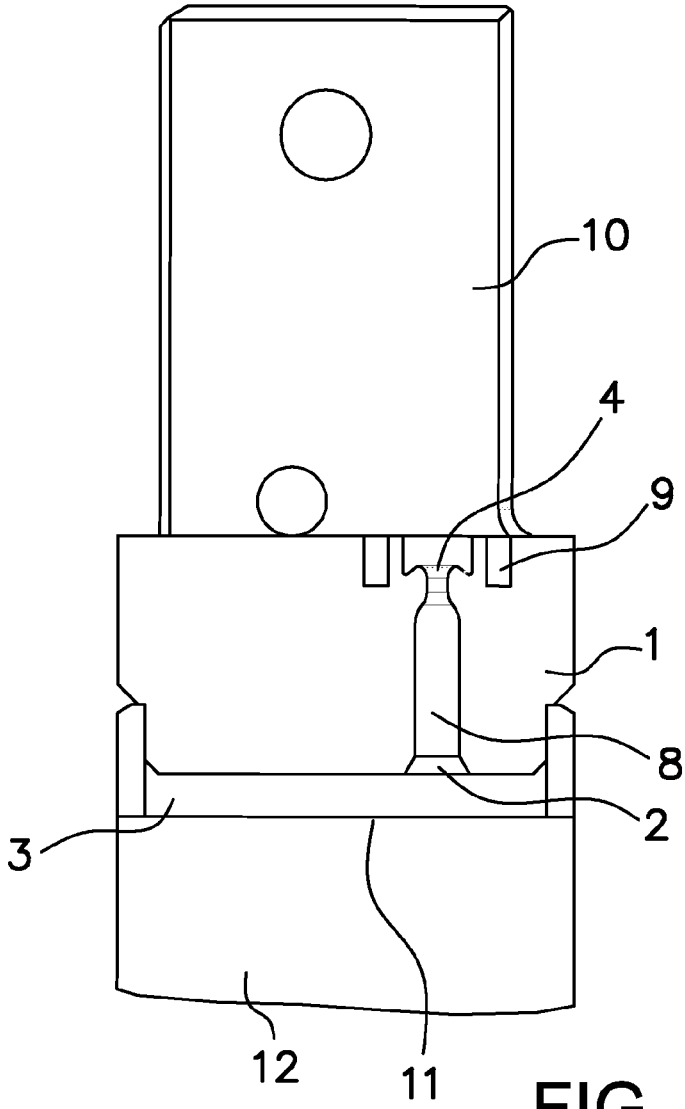
FIG. 5 is a section view of the finished bushing after applying the method of this invention.

Lastly, FIG. 5 shows the finished bushing 1 with its extensions 10, rifle chamber 12, entrance orifice 2, calibrated connection passage 8, exit orifice 4, cavity 9 and compression chamber 3.

It is necessary to point out that bushing 1 is an embodiment like the one described in the following description of the method, even though it may be developed in different manners.

Thus, in a specific embodiment, the bushing manufacturing method would be as follows.

Bushing 1 initially has a tubular configuration, with an entrance orifice 2 facing the chamber 12 of the sporting rifle or pistol. Said entrance orifice 2 connects with compression chamber 3.

The bushing also comprises a connection passage 8 between compression chamber 3 and the outside so that it communicates the air or gas from rifle chamber 12 with the rifle barrel (not shown).

Connection passage 8 ends in exit orifice 4.

As previously described, depending on the country and national legislation, it is necessary to regulate the pellet output power. To this end, this invention provides the calibration of the connection passage 8 in order not to allow the flow of more air or gas than is necessary to comply with said legislation.

The method provides to start with the connection passage 8 corresponding to the most permissive regulation, in other words, with the highest output energy, in order to limit by calibration said connection passage according to the regulation of each country.

Thus, a forming tool 5 is placed over the exit orifice 4, which tool ends in a calibrating plunger 6, just as shown in FIG. 3.

Then, the mentioned forming tool 5 is lowered to insert the calibrating plunger 6 into exit orifice 4. The thickness of calibrating plunger 6 will determine the width of the connection passage 8 after calibration. In other words, if in order to obtain an output power having a specific energy value, it has been calculated that the connection passage 8 has to be of "n" millimeters, then the calibrating plunger thickness shall be the same.

Subsequently, when calibrating plunger 6 is fully inserted into connection passage 8, the tool 5 strikes said exit orifice 4 and deforms the material of the bushing. The impact on exit orifice 4 causes the connection passage to narrow until it adopts the diameter of calibrating plunger 6.

Then calibrating plunger 6 and tool 5 are raised until the initial position and bushing 1 is now ready for use.

Optionally, prior to lowering calibrating plunger 6, there is the option (just as shown in FIGS. 3 and 4) to have a centering element 7 around exit orifice 4.

This centering element 7 prevents possible deviations of the plunger caused by vibration and maladjustments. It is an element that guarantees operational reliability.

Said centering element 7 connects said exit orifice 4 with the outside and has a larger diameter than that of tool 5 so that it can be housed inside it.

In turn, bushing 1 comprises cavity 9, with the shape of centering element 7 base perimeter, in which centering element 7 is partially housed.

In this embodiment, just as shown in FIGS. 3 and 4, centering element 7 and tool 5 are cylindrical, which facilitates adjustments of the up and down movement of tool 5.

The bushing, which is the object of the method, has a tubular configuration, with an entrance orifice 2 that connects with a compression chamber 3 as previously described.

Bushing 1 comprises a connection passage 8 between said compression chamber 3 and the outside, defining an exit orifice 4 that is deformed by compression by tool 5, with a calibrated narrowing 13 with a smaller diameter than the connection passage 8 and, coinciding with the outside diameter of calibrating plunger 6.

Bushing 1 comprises a cavity 9 around exit orifice 4 in which centering element 7 is partially housed.

It must be pointed out that the calibration of the connection passage 8 could be obtained in other ways, for example, by compression, by deformation, by fitting a hollow welded cylinder inside that reduces the inside diameter of connection passage 8, etc.

It is also possible to design internal projections that reduce the inside diameter at a specific point inside referred connection passage 8.

Another option would be to perform the previous method in entrance orifice 2 or connection passage 8, or a combination of the two, instead of exit orifice 4.

In this way, the manufacturer would have the same sporting rifle or pistol with the same firing mechanism. When an order is received from a given country, depending on its legislation, it would have a determined output energy that would correspond specifically to bushing 1, which would be welded to the sporting rifle or pistol chamber output.

If another order is received from a different country, it would only be necessary to change the bushing, without any need to modify the sporting rifle or pistol firing mechanism configuration.

As an example, a series of results obtained with said method are provided after firing a sporting rifle:

| Connection passage 8 diameter (mm) | Cross section of passage 13 (mm2) | Energy (mean values in joules) |
|---|---|---|
| 0.5 | 0.20 | 0.32 |
| 0.6 | 0.28 | 0.31 |
| 0.7 | 0.38 | 0.42 |
| 0.8 | 0.50 | 0.55 |
| 1.1 | 0.95 | 1.05 |
| 1.3 | 1.33 | 7.40 |
| 1.5 | 1.77 | 10.53 |
| 1.6 | 2.01 | 11.82 |
| 1.8 | 2.54 | 13.61 |
| 2.0 | 3.14 | 14.63 |
| 2.2 | 3.80 | 16.22 |
| 2.6 | 5.31 | 19.13 |
| 3.2 | 8.04 | 19.67 |

Relating to the so-called commercial energies, those that are employed according to national legislation, some examples are given below of the required diameters for narrowed passage 13.

| Connection passage 8 diameter (mm) | Cross section of passage 13 (mm2) | Energy (mean values in joules) |
|---|---|---|
| 1.2 | 1.13 | 7.5 |
| 1.4 | 1.54 | 10.0 |
| 1.5 | 1.77 | 12.0 |
| 2.1 | 3.46 | 16.0 |

An example of energy values corresponding to the legislations of certain countries.

| Country | Output energy by Law (joules) |
|---|---|
| Germany, Italy, Russia and Lithuania | 7.5 |
| Sweden and France | 10.0 |
| Latvia | 12.0 |
| The United Kingdom and Trinidad and Tobago | 16.0 |
| Spain, South Africa, Finland, New Zealand, Belgium, Australia and Brazil | 24.2 |
| USA | >24.2 |

This invention describes a new bushing for sporting pistol or rifle chamber and the method for its manufacture. The examples mentioned here do not limit this invention, which thus may have various applications and/or adaptations, all within the scope of the following claims.

The invention claimed is:

1. A hushing for the chamber of a sporting pistol or rifle, the bushing comprising a tubular configuration, the bushing comprising a connection passage between a compression chamber and outside the compression chamber, the connection passage having an entrance orifice and an exit orifice, the exit orifice surrounded by a cavity that partially houses a centering element, the connection passage having a first diameter and a narrowed section with a smaller diameter less than the first diameter, said narrowed section consisting of a deformation of the connection passage, the exit orifice, the entrance orifice, or a combination thereof, said narrowed section calibrated to a predetermined value that is a function of the output energy of the sporting pistol or rifle.

2. A method for the manufacture of a hushing for a sporting pistol or rifle chamber, the bushing comprising a tubular configuration, the bushing comprising a material that defines a connection passage between a compression chamber and outside the compression chamber, the connection passage having an entrance orifice and an exit orifice, the method comprising:

(a) deforming the connection passage, the exit orifice, the entrance orifice, or a combination thereof, to create a deformation having a predetermined value that is a function of the output energy of the sporting pistol or rifle, said deforming comprising the steps of:

(i) disposing a forming tool adjacent said exit orifice in an initial position, said forming tool ending in a calibrating plunger having a diameter;

(ii) advancing the forming tool so the calibrating plunger enters the connection passage until the forming tool strikes said exit orifice, causing the material of the bushing to be deformed until the deformation adopts the diameter of the calibrating plunger, and (iii) returning the calibrating plunger and the forming tool to the initial position.

3. The method of claim 2, further comprising, prior to the step of advancing the calibrating plunger, disposing a centering element around the exit orifice, the centering element having a diameter greater than a diameter of the forming tool.

4. The method of claim 3, wherein the bushing comprises a cavity in which the centering element is partially housed.

5. The method of claim 4, wherein the centering element and tool are cylindrical.

6. The method of claim 2, wherein the deforming step comprises compressing the material of the bushing adjacent the exit orifice to create the deformation.

7. The method of claim 2, wherein the step of advancing the forming tool comprises lowering the forming tool, and the step of returning the forming tool comprises raising the forming tool.

8. A sporting pistol or rifle comprising the bushing of claim 1.

* * * * *